US006591710B1

(12) United States Patent
Shaw

(10) Patent No.: US 6,591,710 B1
(45) Date of Patent: Jul. 15, 2003

(54) SINGLE CANTILEVER SPRING PEDAL FEEL EMULATOR

(75) Inventor: Schuyler Scott Shaw, Dayton, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/641,861

(22) Filed: Aug. 18, 2000

Related U.S. Application Data

(60) Provisional application No. 60/185,457, filed on Feb. 28, 2000.

(51) Int. Cl.[7] ..... G05G 1/14

(52) U.S. Cl. ..... 74/512; 74/513; 74/514; 74/560; 123/399

(58) Field of Search ..... 74/512, 513, 514, 74/560; 123/399; 73/118.1

(56) References Cited

U.S. PATENT DOCUMENTS

| | | | | | |
|---|---|---|---|---|---|
| 4,130,027 | A | * | 12/1978 | Leighton | 74/512 |
| 4,300,409 | A | * | 11/1981 | Leighton | 74/512 |
| 4,695,819 | A | * | 9/1987 | Bowsher | 74/512 X |
| 4,888,997 | A | * | 12/1989 | Eckert et al. | 74/512 X |
| 5,309,361 | A | * | 5/1994 | Drott et al. | 123/399 X |
| 5,603,217 | A | | 2/1997 | Majersik et al. | |
| 5,729,979 | A | | 3/1998 | Shaw et al. | |
| 5,819,593 | A | * | 10/1998 | Rixon et al. | 74/514 |
| 5,934,152 | A | * | 8/1999 | Aschoff et al. | 74/513 |
| 6,003,404 | A | * | 12/1999 | Hannewald | 74/512 |
| 6,186,026 | B1 | * | 2/2001 | Shaw et al. | 74/560 X |
| 6,253,635 | B1 | * | 7/2001 | Huber | 74/512 |
| 6,298,746 | B1 | * | 10/2001 | Shaw | 74/560 X |
| 2001/0015111 | A1 | * | 8/2001 | Rixon et al. | 74/512 |

FOREIGN PATENT DOCUMENTS

| | | | | | |
|---|---|---|---|---|---|
| DE | 19500568 | A1 | * | 7/1996 | 74/512 |
| GB | 2241050 | A | * | 8/1991 | 74/512 |

* cited by examiner

*Primary Examiner*—Vinh T. Luong
(74) *Attorney, Agent, or Firm*—Scott A. McBain

(57) ABSTRACT

A brake pedal assembly for a vehicle equipped with an electronic or "brake-by-wire" braking system includes a brake pedal feel emulator which mimics or emulates the pedal feel of a conventional hydraulic braking system. The brake pedal feel emulator includes a single cantilever spring which reacts against a shaped surface and is mounted such that the free end thereof applies a force to the brake pedal which varies as the point at which the spring diverges from the shaped surface changes in response to movement of the brake pedal. The free length of the spring is therefor varied as the pedal is depressed as a function of the shape of the shaped surface, so the force applied to the pedal may be designed to vary to emulate the feel of a conventional braking system.

11 Claims, 3 Drawing Sheets

SINGLE CANTILEVER SPRING PEDAL FEEL EMULATOR

This application claims domestic priority based upon U.S. Provisional Patent Application No. 60/185,457, filed Feb. 28, 2000.

TECHNICAL FIELD

This invention relates to a motor vehicle brake pedal for an electronic or "brake-by-wire" braking system which includes a brake pedal feel emulator which artificially mimics or emulates the pedal feel of a traditional hydraulic braking system.

BACKGROUND OF THE INVENTION

Early motor vehicles were equipped with hydraulic braking systems in which a master cylinder was directly actuated by a brake pedal to operate the vehicle brakes. The force applied by the operator to the brake pedal was opposed by a force generated by the hydraulic force applied to the vehicle brakes. This force initially increased quite slowly because compliance in the hydraulic system and in the brakes had to be taken up and the force of return springs of drum brakes had to be overcome. After this initial phase, the force applied to the brake pedal is increased at an exponential rate. Vehicle operators are accustomed to this pedal "feel" characteristics of manual braking systems and expect all braking systems to react in the same way. For example, when power assisted brakes were introduced, the power booster had to incorporate the feel of the prior manual braking systems in order to be acceptable to vehicle operators.

More recently, electronic or "brake-by-wire" braking systems have been proposed. In such systems, braking is generated by an electro-hydraulic system in which the brake pedal generates an electrical signal which controls an electronic controller which controls the operation of a pump that applies the vehicle brakes, or the brakes include an electric motor which is controlled by the signal transmitted to the electronic controller by the brake pedal. Accordingly, these electronic braking systems must incorporate a pedal which provides "feel" to the vehicle operator that emulates the feel vehicle operators are accustomed to as described above. Prior art brake pedal feel emulators are disclosed in U.S. Pat. Nos. 5,729,979 and 5,603,217.

SUMMARY OF THE INVENTION

According to the present invention, a single cantilever spring reacts against a shaped surface and is mounted such that the free end thereof applies a force to the brake pedal which varies as the point at which the spring diverges from the shaped surface changes in response to movement of the brake pedal. The free length of the spring is therefor varied as the pedal is depressed as a function of the shape of the shaped surface, so that the feedback force applied to the pedal may be designed to vary to emulate the feel of a conventional braking system.

DESCRIPTION OF THE PREFERRED EMBODIMENT

Figure 1:
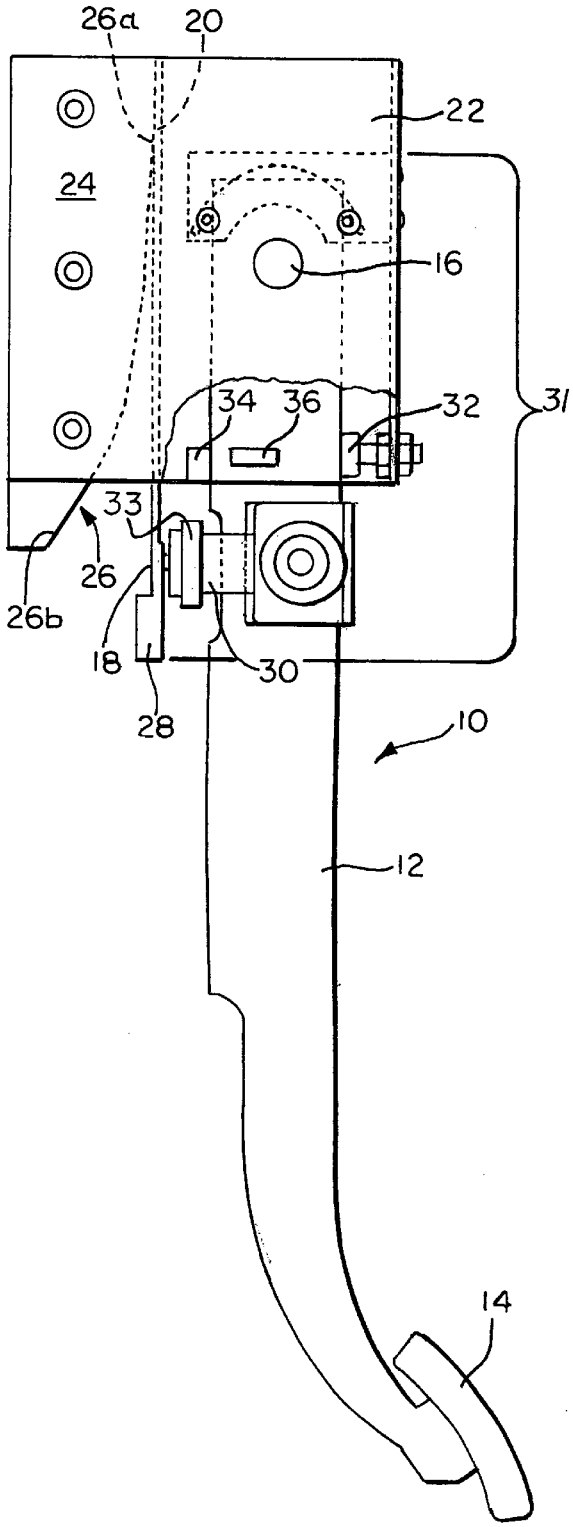
FIG. 1 is a side elevational view, partly in section, of a brake pedal assembly incorporating a brake pedal feel emulator made pursuant to the teachings of the present invention.

Referring now to the drawings, a vehicle pedal assembly generally indicated by the numeral 10 includes a pedal arm 12 having a pad 14 on one end thereof and a pivot connection 16 at the other end thereof which pivotally mounts the pedal arm 12 to a motor vehicle. A cantilever spring 18 extends parallel to the pedal arm 12 and includes a fixed end 20 secured to the vehicle through a housing 22 which is also attached to the vehicle. The housing 22 supports the pedal arm 12 through the pivot connection 16 and a bracket 24 which carries a shaped surface 26. The shaped surface 26 is shaped as will hereinafter be explained and extends parallel to the spring 18 such that the spring 18 progressively engages the shaped surface 26 as the pedal arm 12 is pivoted toward the shaped surface 26. The cantilever spring 18 further includes a free end 28, which pivotally engages one end of a link 30, the other end of which is pivotally connected to the pedal arm 12. The cantilever spring 18 urges the pedal arm 12 against an adjustable stop 32 mounted on the housing 22.

Since the force transmitted through the link 30 is a function of the braking force generated by the vehicle operator, the link 30 may include a load cell 33 which generates an electrical signal which varies with accordance with the load transferred through the link 30. This signal is transmitted to the aforementioned controller which controls the brake application. In addition to the signal from the load cell 33, the controller may also be designed to respond to an electrical signal representing the position of the pedal arm 12. Accordingly a Hall effect sensor 34 is mounted on the housing 22, and a magnet 36 is mounted on the pedal arm 12 in a position such that it moves toward the magnet 36 when a brake application is effected. The Hall effect sensor 34 generates an electrical signal which varies as a function of the distance between the Hall effect sensor 34 and the magnet 36, thereby generating an electrical signal which varies as a function of the position of the pedal arm 12 during a brake application. The electrical controller responds to both the signal from the Hall effect sensor 34 and the signal from the load cell 33 within the link 30 to sense spike brake applications, etc. and to modulate braking accordingly. The duel signals are also useful for redundancy so that a signal may be received by the controller in the event of the failure of one of the sensors or of one of the electrical lines connecting the sensors to the controller.

As is known to those skilled in the art, the force required to effect a given deflection of the cantilever spring 18 is a function of a free length 31 of the spring, a shorter free length 31 requiring a greater force and a longer free length 31 requiring a lesser force. The shaped surface 26 is a curvilinear surface shaped so that the engagement point of the spring 18 on the shaped surface 26 moves downwardly viewing FIG. 1 from the upper end 26*a* of the shaped surface 26 adjacent the fixed end 20 of the spring 18 to the lower end 26*b* of the shaped surface 26. The shaped surface 26 is shaped so that the free length 31 of the cantilevered spring 11 will vary, so that the force applied to the pedal arm 12 will also vary, in a manner that will provide the required "feel" or force feedback to the vehicle operator. Since the surface 26 is shaped to cause the spring 18 to generate feedback forces, the shaped surface 26 may not necessarily conform to the natural arc of the spring 18 as it is deflected, so that gaps may occur between the spring 18 and the shaped surface 26.

It will also be noted that the radius of curvature of the shaped surface 26 is relatively large at the upper end 26*a* and thus his portion of the shaped surface 26 is relatively flat. The radius of curvature decreases to a minimum curvature at the lower end 26*b* . Accordingly, when the pedal arm 12 is initially moved away from the stop 32, the point of contact between the spring 18 and the shaped surface 26 moves along the relatively flat portion of the shaped surface 26 adjacent the fixed end 20 of the spring 18, and thus the point of contact between the spring 18 and the shaped surface 26 changes relatively little during initial movement of the pedal arm 12 away from the stop 32, so that the free length 31 of the spring 18 also changes a relatively small amount. Accordingly, the feedback force transmitted to the vehicle operator will also increase at a relatively small rate indicative of the initial portion of a brake application. Additional movement of the pedal arm 12 causes the point of contact between the spring 18 and the shaped surface 26 to move along the more sharply curved portion of the shaped surface 26, thereby decreasing the free length 31 of the spring 18 at a continually increasing (exponential) rate, thereby increasing the feedback force on the pedal arm 12 at a similar rate. Accordingly, the feedback force after the initial movement of the pedal arm 12 increases at an exponential rate, providing a feedback force or pedal "feel" that is similar to the feel to which vehicle operators have become accustomed.

Accordingly, the feedback force transmitted to the vehicle operator will also increase at a relatively small rate indicative of the initial portion of a brake application. Additional movement of the pedal causes the point of contact between the spring 18 and the shaped surface 26 to move along the more sharply curved portion of the shaped surface, thereby decreasing the effective length of the spring 18 at a continually increasing (exponential) rate, thereby increasing the feedback force on the pedal arm at a similar rate. Accordingly, the feedback force after the initial movement of the pedal arm increases at an exponential rate, providing a feedback force or pedal "feel" that is similar to the feel to which vehicle operators have become accustomed.

Figure 2:
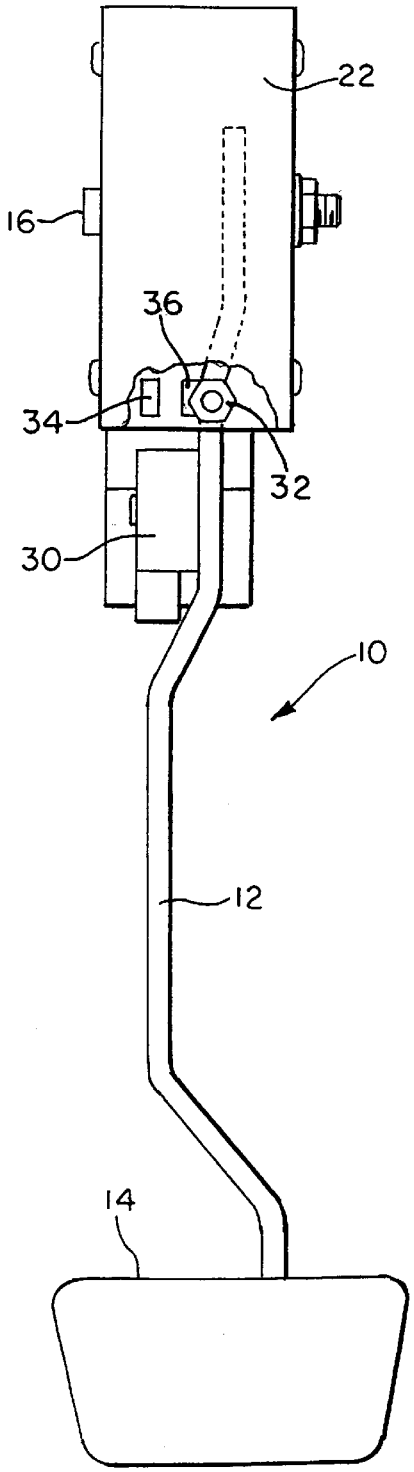
FIG. 2 is a front elevational view of the brake pedal assembly illustrated in FIG. 1.
Figure 3:
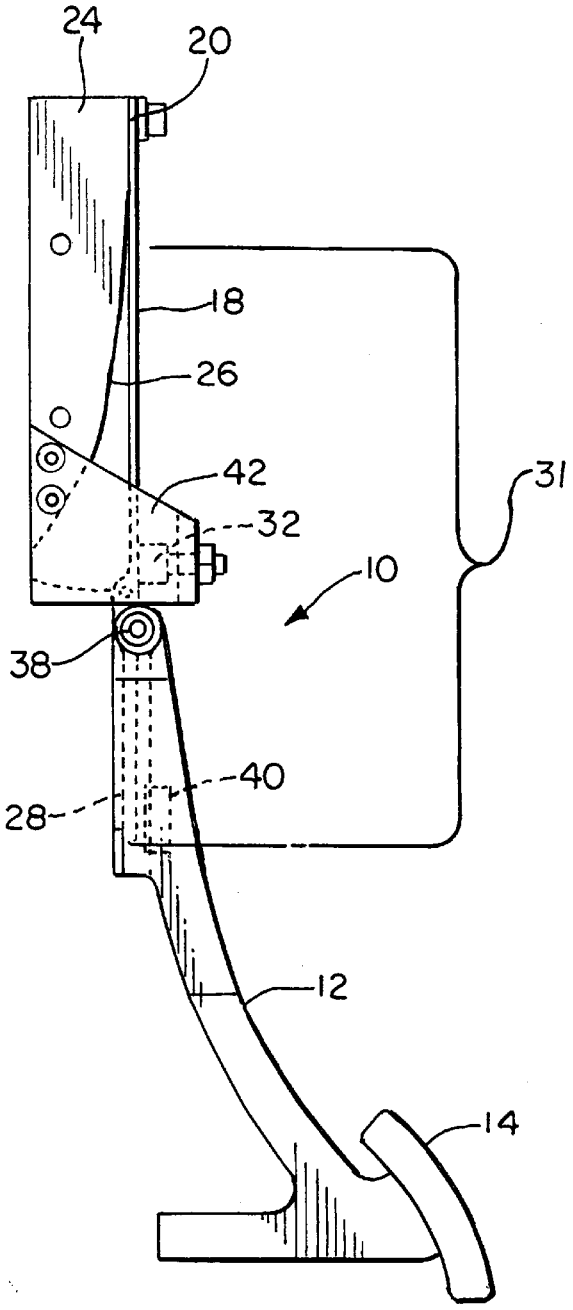
FIGS. 3 and 4 are views similar to FIGS. 1 and 2 respectively, but illustrating another embodiment of the invention.
Figure 4:
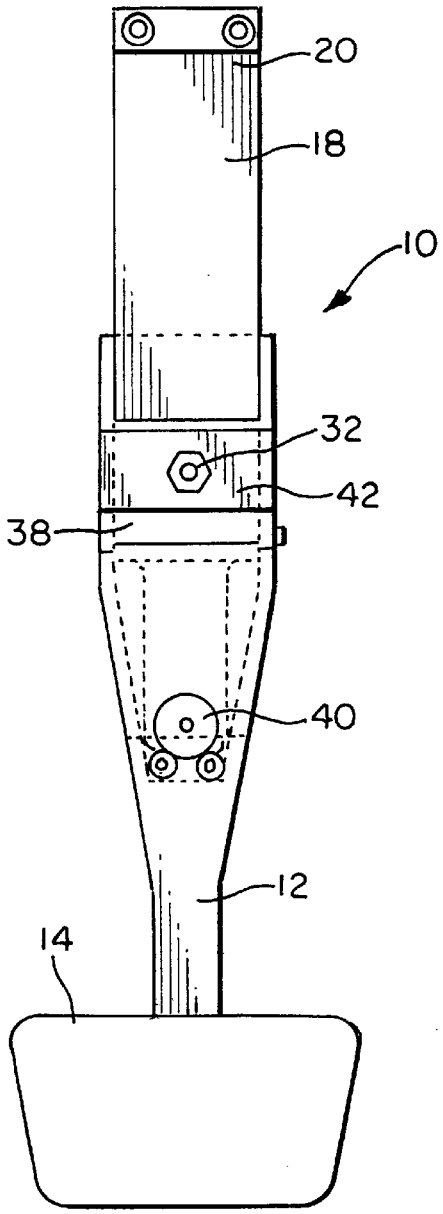

Referring now to the embodiment of FIGS. 3 and 4, where elements the same or substantially the same as those in the embodiment of FIGS. 1 and 2 retain the same reference character, the fixed end 20 of the cantilever spring 18 is secured to the bracket 24, which is secured to the vehicle. The pedal arm 12 is secured to the cantilever spring 18 via a pivot 38 between the fixed end 20 and the free end 28. A link 40, which incorporates a load cell that generates an electrical signal as described above, connects the free end 28 with the pedal arm 12. The adjustable stop 32 is mounted on a U-shaped bracket 42 which extends from the bracket 24. A Hall effect sensor (not shown) may be mounted on the bracket 42 and a magnet (not shown) may be mounted on the portion of the cantilever spring 18 extending through the bracket 42 to sense movement of the pedal aim 12 as described above. When a brake application is effected, the cantilever spring 18 wraps around the shaped surface 26 in the same manner as described above with respect to the embodiment of FIGS. 1 and 2 to thereby change the effective length of the spring 18 to provide a variable feedback force transmitted through the link 40 to the pedal arm 12, thereby providing braking "feel" to the vehicle operator.

Figure 5:
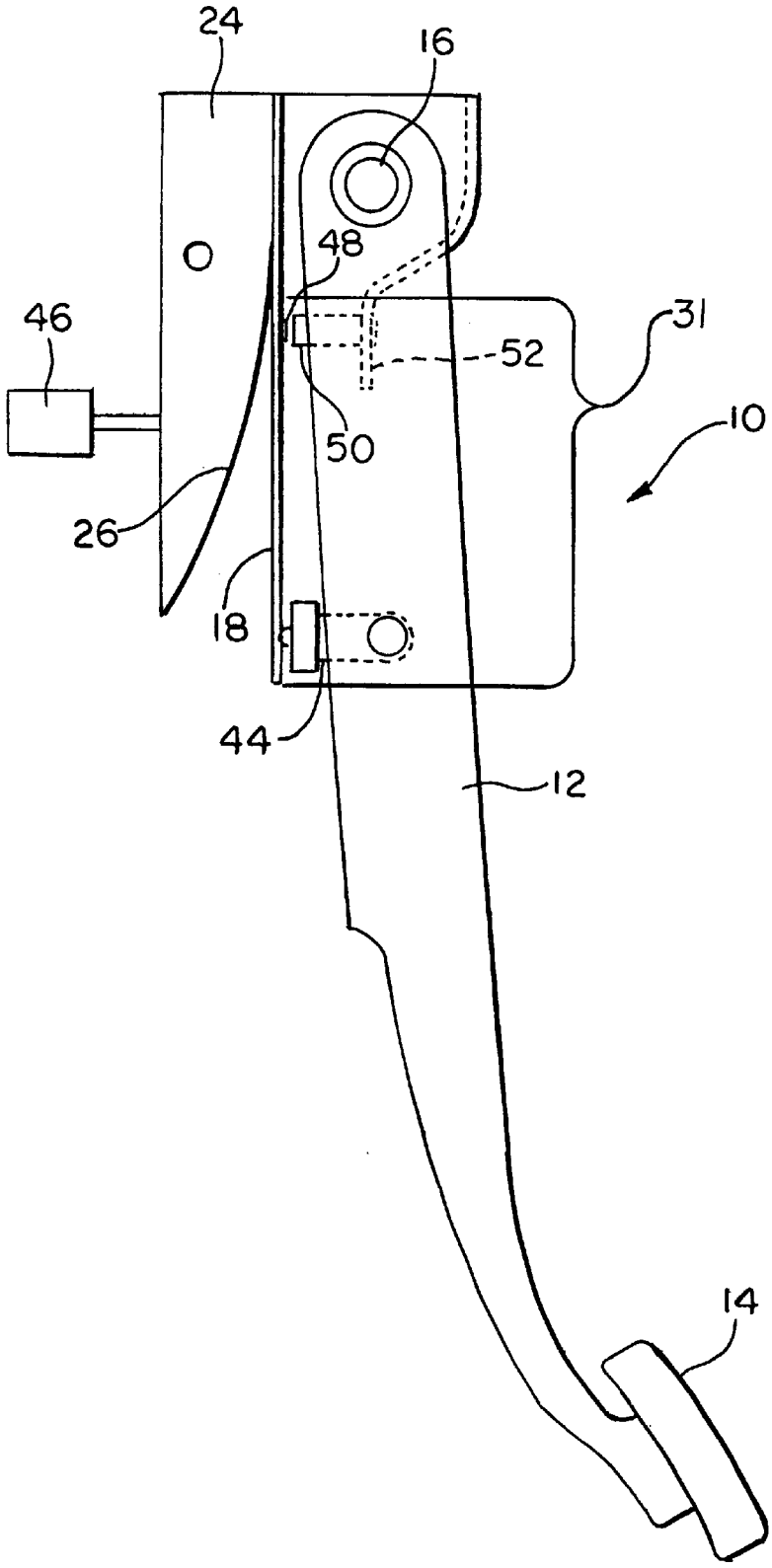
FIG. 5 is a view similar to FIG. 1, but illustrating still another embodiment of the invention.

Referring now to the embodiment of FIG. 5, where elements the same or substantially the same as those in the embodiment of FIGS. 1 and 2 retain the same reference character, a link 44, which does not incorporate a load cell, transmits feedback forces providing braking "feel" to the pedal arm 12. Since braking forces are also transmitted through the bracket 24 which carries the shaped surface 26, these braking forces are sensed by a load cell 46, which generates an electrical signal which varies as a function of the forces exerted on the bracket 24. Since the cantilever spring 18 deflects in response to movement of the pedal arm 12, an electrical signal representing pedal arm movement may be generated by a magnet 48 mounted on the cantilever spring 18, which is moved toward and away from a Hall effect sensor 50 mounted on a bracket 52 secured to the vehicle.

What is claimed is:

1. A brake pedal assembly comprising:

a housing;

a pedal arm having a first end and a second end;

a pad mounted on said first end of said pedal arm;

a pivot mount on said second end of said pedal arm for permitting said pedal arm to pivot about said pivot mount relative to said housing upon a brake application;

a shaped surface mounted on said housing;

a cantilever spring arm having a fixed end mounted on said housing and a free end opposite said fixed end, said spring arm extending along said pedal arm and continuously abutting said shaped surface;

a link extending between said spring arm and said pedal arm for operatively engaging said spring arm with said pedal arm such that said spring arm is deflected against said shaped surface by pivoting of the pedal arm about said pivot mount when the brake application is effected, and said spring arm diverges from said shaped surface to define a free length of said spring arm which varies as said pedal arm pivots, whereby said free length of said spring arm exerts a varying feedback force on said pedal arm which varies as a function of said free length of said spring arm.

2. A brake pedal assembly as claimed in claim 1, wherein said shaped surface is nonlinear.

3. A brake pedal assembly as claimed in claim 1, further comprising a load cell for generating an electrical signal which varies as a function of the force exerted on said pedal arm by said spring arm.

4. A brake pedal assembly as claimed in claim 1, further comprising a position sensor which senses movement of said pedal arm and generates an electrical signal which varies as a function of the distance between said pedal arm and said shaped surface.

5. A brake pedal assembly as claimed in claim 1, wherein said pivot mount pivotally mounts said pedal arm on said housing adjacent said fixed end of said spring arm.

6. A brake pedal assembly as claimed in claim 1, wherein said pivot mount pivotally mounts said pedal arm on said spring arm.

7. A brake pedal assembly as claimed in claim 1, further comprising a sensor which measures deflection of said shaped surface and generates an electrical signal which varies as a function of the deflection of said shaped surface.

8. A brake pedal assembly as claimed in claim 1, wherein said shaped surface is a curvilinear surface.

9. A brake pedal assembly as claimed in claim 1, wherein said shaped surface extends along said spring arm add is a curvilinear surface having a larger radius of curvature adjacent said fixed end of said spring arm and a decreasing radius of curvature as said shaped surface extends from said fixed end.

10. A brake pedal assembly as claimed in claim 9, further comprising a load cell for generating an electrical signal which varies as a function of the force applied to said pedal arm by said spring arm and a position sensor for generating an electrical signal which varies as a function of the angular position of said pedal arm.

11. A brake pedal assembly as claimed in claim 1, wherein said shaped surface extends along said spring arm and has a varying radius of curvature.

* * * * *